United States Patent [19]

Tseung et al.

[11] 4,279,713

[45] Jul. 21, 1981

[54] METHOD OF CATALYSING THE EVOLUTION OF GASEOUS HYDROGEN

[75] Inventors: Alfred C. C. Tseung; Maurice C. M. Man, both of London, England

[73] Assignee: National Research Development Corporation, London, England

[21] Appl. No.: 116,676

[22] Filed: Jun. 22, 1979

[51] Int. Cl.[3] ..... C25B 11/06; C25B 1/04

[52] U.S. Cl. ..... 204/129; 204/290 R; 204/291

[58] Field of Search ..... 204/290 R, 291, 129

[56] References Cited

U.S. PATENT DOCUMENTS 4,035,254 7/1977 Gritzner ..... 204/128
4,035,255 7/1977 Gritzner ..... 204/128

FOREIGN PATENT DOCUMENTS 1461764 1/1977 United Kingdom ..... 204/290 R

OTHER PUBLICATIONS

Electrochemica Acta, vol. 23, Oct. 1978, pp. 1023–1029.
Chem. Abstracts, vol. 82, Apr. 21, 1975, Abstract No. 101137.
Chem. Abstracts, vol. 82, Jun. 16, 1975, Abstract No. 161804.

*Primary Examiner*—R. L. Andrews
*Attorney, Agent, or Firm*—Cushman, Darby & Cushman

[57] ABSTRACT

In chlor-alkali cells, the cathode may consist of a nickel screen carrying 15.6 mg $Co_2NiS_4$ bonded by 4.4 mg polytetrafluoroethylene per $cm^2$.

3 Claims, 2 Drawing Figures

METHOD OF CATALYSING THE EVOLUTION OF GASEOUS HYDROGEN

This invention relates to a method of catalysis, hydrogen produced by the method and to a porous electrode (intended to be suitable for evolving gas). The invention may be used in industrial catalysis, for example in producing hydrogen from brine or chlor-alkali solutions.

Many electrolysers use planar or mesh electrodes and as such can only give low current densities. A porous electrode which could ensure that most of the electrode surfaces continue to function during gas evolution reaction would give significantly higher current densities. At present, in for example the field of alkali (including chlor-alkali) electrolysis, anodes can be such that the performance of a cell is limited by the cathode, at which hydrogen gas forms. Electrodes including a mixed cobalt/nickel oxide compound have been briefly described in UK Patent Specification No. 1,461,764, but it would be desirable to have electrodes with a higher activity. This invention arises from modifying that compound.

The invention is a method of catalysis using, as a catalyst, particles whose surfaces (to a depth of at least 20Å) are compounds between sulphur optionally including oxygen and at least two of cobalt, nickel, iron and manganese. For example, evolution of gaseous hydrogen (e.g. formed by electrolysing water) may be thus catalysed.

Another aspect of the invention is operating an aqueous alkali electrolysis cell using the catalyst, preferably bonded together in porous fashion by a chemically inert polymeric binder, as a cathode, optionally permitting air to contact the cathode from time to time, in which cell hydrogen is evolved at the cathode.

The invention in another aspect is an electrode made from particles whose surfaces (to a depth of at least 20Å) are compounds between sulphur optionally including oxygen and at least two of cobalt, nickel, iron and manganese bonded together in porous fashion by a chemically inert polymeric binder. The compounds are preferably $A_xB_{4-2x}S_{3.6-4}O_{0.4-0}$ where x is from 0.05 to 1.95 and where A and B are any different two of cobalt, nickel, iron and manganese, for example cobalt and nickel. The binder may be polytetrafluoroethylene, and may represent from 1 to 10 parts (by weight) per 10 parts of the total compounds, preferably 2 to 6 parts.

Thus, a most preferred electrode has 3 parts of polytetrafluoroethylene binding 10 parts of $Co_2NiS_4$.

The compounds may be made by treating the corresponding oxides with a sulphur-bearing compound, e.g. $H_2S$. The oxides may themselves have been made by a method ensuring small particle size, for example freeze-drying, and are described in UK Patent Specification No. 1,461,764.

The invention will now be described by way of example.

In the accompanying drawings.

EXAMPLE 1

A 100 ml solution containing 39.49 g of $Co(NO_3)_2.6H_2O$ and 19.79 g of $Ni(NO_3)_2.6H_2O$ was sprayed onto liquid nitrogen. The frozen metallic salt solution was rapidly transferred to round-bottomed flasks containing liquid nitrogen and subjected to freeze-drying. After drying, the mixed nitrate powder was subjected to vacuum decomposition for three hours at 250° C. followed by thermal treatment in hydrogen sulphide at 350° C. for 8 hours, giving a compound approximating to $Co_2NiS_4$, in practice about $Co_2NiS_{3.6}O_{0.4}$.

Ten parts of the $Co_2NiS_4$, which has a particle size in the region of 0.1μm, were mixed with 3 parts of polytetrafluoroethylene, in the form of a dispersion (60% PTFE content) sold by Imperial Chemical Industries of Britain under the trade mark ICI Fluon GP1, and with just enough de-ionised water to make into a paste-like slurry. The slurry was dispersed ultrasonically and then painted onto a 100 B.S. mesh nickel screen, allowed to dry in air for one hour at 100° C. and then cured in air at 300° C. for an hour.

The cured assembly represents the desired electrode, and offered a $Co_2NiS_4$ loading of 15.6 mg(and 4.4 mg polytetrafluoroethylene) per square centimeter.

Figure 1:
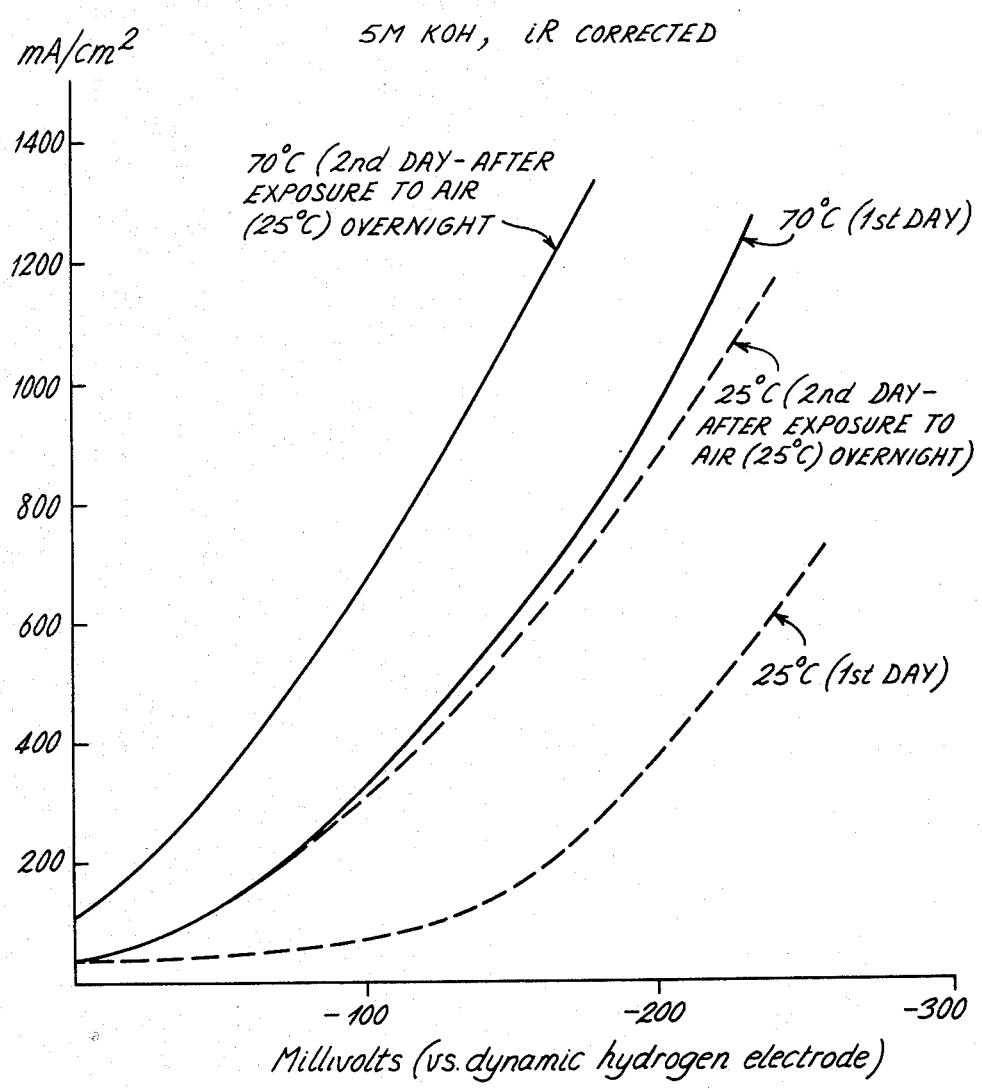
FIG. 1 is a graph illustrating performance obtained according to Example 1.

The electrode was held potentiostatically at −173 mV with reference to a dynamic hydrogen electrode in 5 M KOH at 70° C., with iR correction, an excessively large nickel screen being provided as anode. As may be seen from FIG. 1, on the first day, the electrode passed about 750 mA/cm$^2$. After being exposed overnight to air at 25° C., however, the electrode passed 1300 mA/cm$^2$. This recovery even after exposure to air, shown in both Examples, is an important advantage.

EXAMPLE 2

150 ml of an aqueous solution contained 24.4 g $CoCl_2.6H_2O$ and 12.13 g of $NiCl_2.6H_2O$. This solution was added with constant stirring to 100 ml of 5 M KOH, and the pH was adjusted until chloride ion could not be detected in the filtrate and finally the clean precipitate was heated in an over (containing air) at 400° C. for 21 hours, giving $Co_2NiO_4$.

The $Co_2NiO_4$ was heated to 500° C. and exposed for 5 hours to excess hydrogen sulphide, thus giving $Co_2NiS_4$ as was confirmed by analysis. In any event, it is the superficial composition (i.e. the top 20 Å layer) which influences the electrode behaviour and whose composition must therefore be as defined.

Alternatively, and equally successfully, the freeze-drying method of Example 1 could have been used.

The $Co_2NiS_4$ was made into a slurry, painted onto a nickel screen and cured, in similar fashion to Example 1.

The cured assembly represents the desired electrode, and in this case offered a $Co_2Nis_4$ loading of 22 mg (and 9.3 mg polytetrafluoroethylene) per square centimeter.

Figure 2:
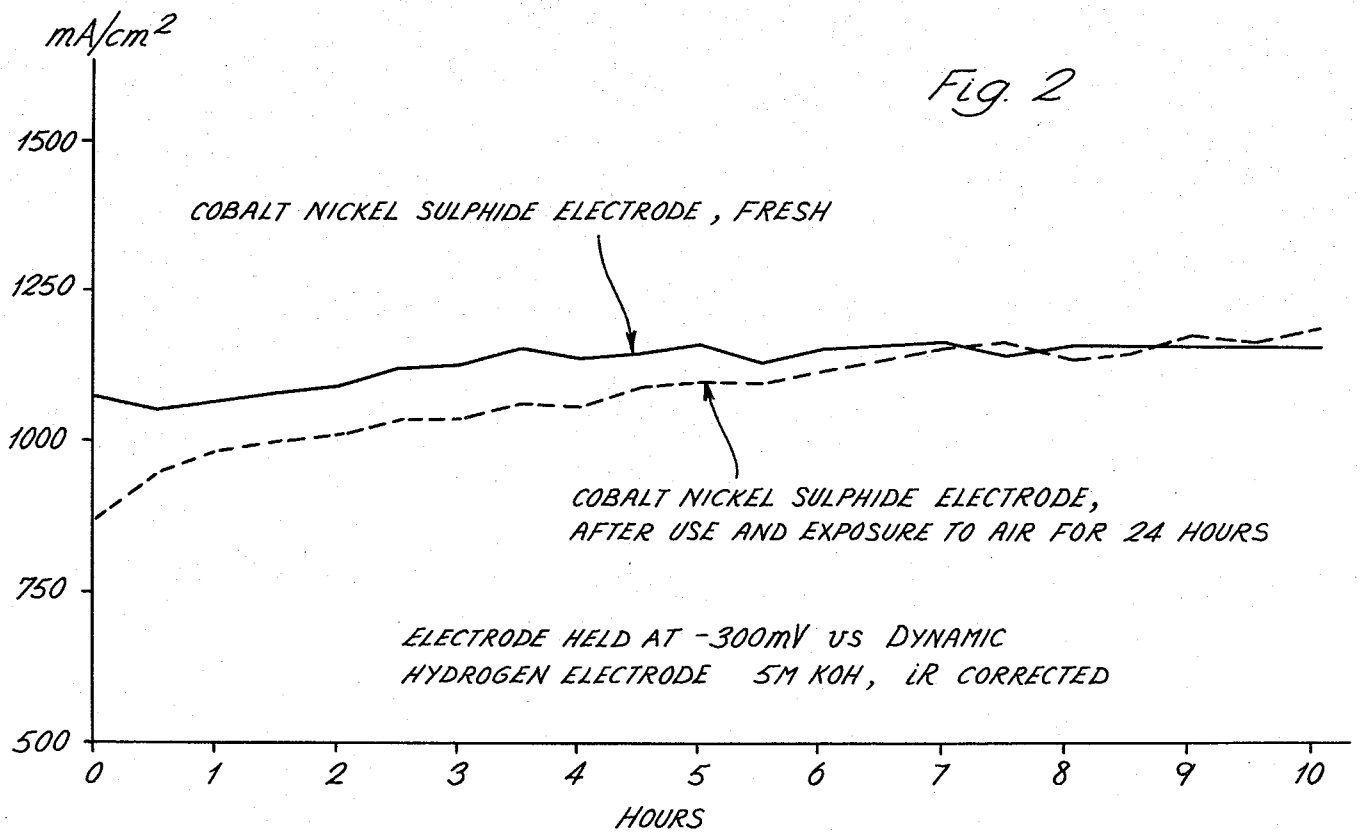
FIG. 2 is a graph illustrating performance obtained according to Example 2.

The electrode was held potentiostatically at −300 mV with reference to a dynamic hydrogen electrode in 5 M KOH at 70° C., with iR correction, an excessively large nickel screen being provided as the counter electrode (anode). As may be seen from FIG. 2, the electrode was able to pass a current of 1150 mA/cm$^2$ even after 10 hours use. Initially, the current was somewhat lower, at about 1050 mA/cm$^2$; if the electrode was used and then left in air for 24 hours, the performance on resuming use was 850 mA/cm$^2$, rising to 1050 mA/cm$^2$ after about 6 hours.

EXAMPLE 3

Example 1 was repeated with the difference that in making the paste-like slurry, methanol was used in place of the de-ionised water. The $Co_2NiS_4$ loading was also much higher, at about 40 to 60 mg /cm$^2$ on the electrode.

The electrode was held potentiostatically at −75 mV with reference to a reversible hydrogen electrode, at 70° C., 5 M NaOH (but otherwise as in Example 1), and gave 250 mA/cm$^2$, (iR corrected) a significant improvement on mild steel cathodes.

In another experiment, the electrode was held at 95° C. in a typical chlor-alkali solution 15% NaOH+17-%NaCl) and set to allow a steady 250 mA/cm$^2$ to pass. This current density was sustained for over 400 hours, with a reasonably steady half cell voltage (i.e.-80 mV with reference to a reversible hydrogen electrode).

These results suggest that the invention could be exploited in industry by, for example, providing an alternative to mild steel cathodes in chlor-alkali electrolysis.

We claim:

1. A method of catalysing the evolution of gaseous hydrogen formed by alkaline water electrolysis in an aqueous alkali electrolysis cell, said method comprising using as the catalyst a cathode coated with particles whose surfaces to a depth of at least 20 Angstroms are sulphur compounds of two metals selected from the group consisting of cobalt, nickel, iron and manganese.

2. A method according to claim 1, wherein the cathode comprises said particles bonded together in porous fashion by a chemically inert polymeric binder.

3. A method of catalysing the evolution of gaseous hydrogen formed by alkaline water electrolysis comprising, using as catalyst, particles whose surfaces to depth of at least 20 Å are sulphur compounds of two metals selected from the group consisting of cobalt, nickel, iron and manganese.

* * * * *

UNITED STATES PATENT AND TRADEMARK OFFICE

CERTIFICATE OF CORRECTION

PATENT NO. : 4,279,713
DATED : July 21, 1981
INVENTOR(S) : Alfred C.C. TSEUNG and Maurice C.M. MAN It is certified that error appears in the above—identified patent and that said Letters Patent is hereby corrected as shown below:

On the Title Page:

Item [22] read "Filed: Jun. 22, 1979" should read

-- Filed: Oct. 20, 1978--

Add: [86] PCT No.: PCT/GB78/00027
§371 Date: June 22, 1979
§102(e) Date: June 22, 1979

[87] PCT Pub. No.: WO 79/00233
PCT Pub. Date: May 3, 1979

[30] Foreign Application Priority Data

October 25, 1977 [UK] 44362/77

Signed and Sealed this

*Twenty-sixth* Day of *January 1982*

[SEAL]

*Attest:*

GERALD J. MOSSINGHOFF

*Attesting Officer*

*Commissioner of Patents and Trademarks*